US012343649B1

(12) United States Patent
Ciraolo

(10) Patent No.: US 12,343,649 B1
(45) Date of Patent: Jul. 1, 2025

(54) SWING HANGER

(71) Applicant: Playground Services Inc., Santee, CA (US)

(72) Inventor: Charles Ciraolo, Santee, CA (US)

(73) Assignee: Playground Services Inc., Santee, CA (US)

( * ) Notice: Subject to any disclaimer, the term of this patent is extended or adjusted under 35 U.S.C. 154(b) by 0 days.

(21) Appl. No.: 18/984,561

(22) Filed: Dec. 17, 2024

(51) Int. Cl.
*A63G 9/12* (2006.01)

(52) U.S. Cl.
CPC ..... *A63G 9/12* (2013.01)

(58) Field of Classification Search
CPC ... A63G 9/00; A63G 9/02; A63G 9/08; A63G 9/12; A63G 9/16; Y10T 403/32975; Y10T 403/32213; Y10T 403/32983; Y10T 403/32606
USPC ..... 472/118, 120–125
See application file for complete search history.

(56) References Cited

U.S. PATENT DOCUMENTS 4,190,283 A * 2/1980 Boucher ..... A63G 9/12 403/65
5,013,166 A * 5/1991 Domer ..... B60G 21/0551 384/220
6,123,480 A * 9/2000 Petty ..... A63G 9/12 403/26
6,669,394 B1 * 12/2003 Rieber ..... A63G 9/12 403/26
6,830,517 B1 * 12/2004 Ciraolo ..... A63G 9/12 403/313

* cited by examiner

*Primary Examiner* — Kien T Nguyen
(74) *Attorney, Agent, or Firm* — Cynthia S. Lamon; Lamon Patent Services

(57) ABSTRACT

A swing hanger has an inner bearing assembly with a centered raceway, in two mirror image mating parts, and an outer bearing assembly adapted rotate in the raceway, with the inner bearing assembly having the mirror image parts keyed to prevent relative movement when secured to a crossbar, and the outer bearing assembly hinged to be opened and closed around the inner bearing assembly in a manner that there is no extension beyond the outer diameter of the outer bearing assembly.

10 Claims, 6 Drawing Sheets

SWING HANGER

BACKGROUND OF THE INVENTION

1. Field of the Invention

The present invention is in the technical field of hardware associated with playground swing sets and relates more particularly to a clamp with a bearing that joins to a crossbar of a swing frame to suspend chain for a swing.

2. Description of Related Art

Playground swings are well-known in the art as are hardware elements for suspending chains for swings from a horizontal crossbar. One problem with playground swing sets is that children often throw the swings over the upper crossbar of the swing set so that the swings may ultimately become wrapped around the crossbar. Wrapped swings are typically unusable and must be unwrapped by maintenance personnel. A swing that is wrapped around the crossbar only once, and evenly, may appear to be usable; however, its use may damage the crossbar or the chains that support the swing seat, or could prove dangerous to the user. Unwrapping swings consumes the time of maintenance personnel and is thus expensive. It is thus desirable to provide a device that prevents the swings from being wrapped over the cross bar.

The present inventor has provided a swing hanger in the prior art as shown in U.S. patent Ser. No. 10/857,717 that has some issues that need improvement. In the prior art, for example, a swing hanger is provided that has an inner bearing unit in two mating parts 21T and 21B (FIG. 3 of U.S. Ser. No. 10/857,717) that fasten around a crossbar 82 and are fastened to the crossbar by conventional screws 28. The mating halves have no key or locking elements that ensure alignment.

In the prior art apparatus the inner bearing units, assembled around a crossbar, provide a depressed raceway 32 to mate with an outer bearing member comprising two parts 41F and 41R. The outer bearing mates with the inner bearing, and rotates around the inner bearing, as the inner bearing is joined rigidly to the crossbar.

Figure 4:
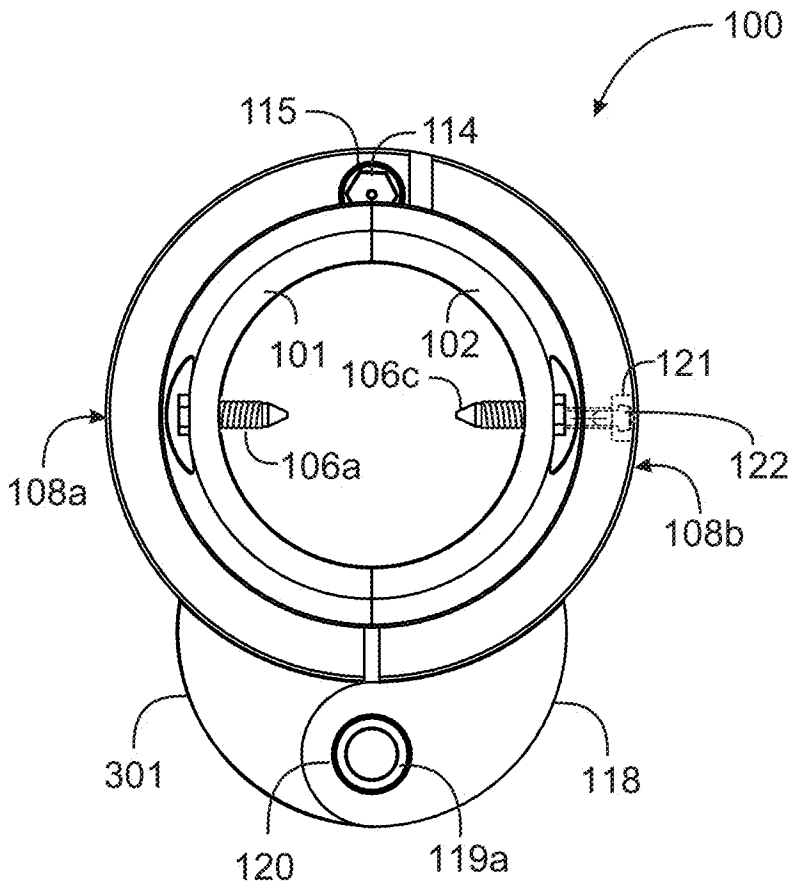
Figure 5:
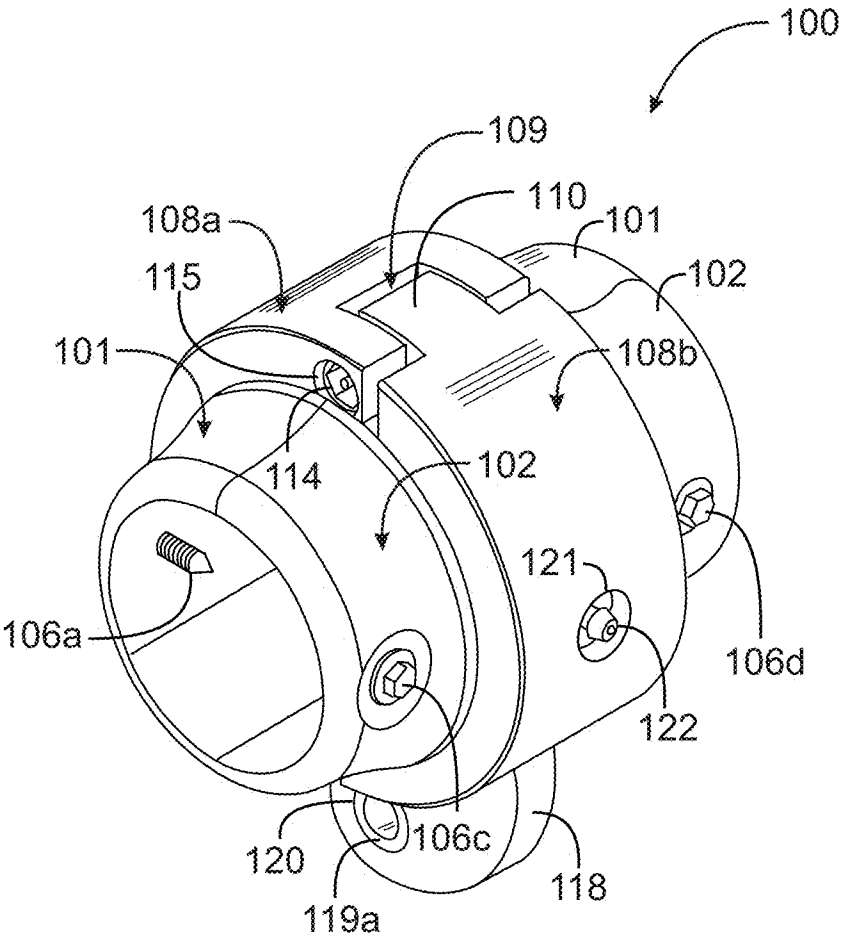

It may be seen in FIGS. 4 and 5 of U.S. Ser. No. 10/857,717 that the outer bearing assembly has a pivot hinge 47 that protrudes outward from the outer bearing assembly. Another problem with the prior art assembly is that there is no provision for lubrication after assembly. Additionally, the swing hanger of U.S. Ser. No. 10/857,717 was not able to pass America Society for Testing and Materials (ASTM) certification, which is needed for the product to be used in a commercial or public setting. What is needed is a design that is capable of receiving ASTM certification and is a new swing hanger that has no unneeded protrusions, that provides secure mating of the elements of the inner bearing unit and provides for lubrication after a period of use.

BRIEF SUMMARY OF THE INVENTION

A swing hanger is described comprising an inner bearing assembly having a first part in a shape of a semi-circle with a concave side having a first radius and a first length in a direction of an axis of the semi-circle, and a convex side having a centered, depressed raceway of a second length less than the first length. A convex bearing surface is provided including a second radius greater than the first radius, the inner bearing assembly further having a second part as a mirror image of the first part, such that the two parts joined form the inner bearing assembly having a circular center opening with a diameter twice the first radius.

In this embodiment an outward facing circular depressed raceway formed of the depressed raceways of the first and second parts, the first part having a key slot and the second part having a key element sized to the key slot, such that the two parts joined are constrained from relative movement in the direction of the axis. An outer bearing assembly is included having a first part in a shape of a semi-circle with a convex side presenting a bearing surface having the second radius and a third length in the direction of the axis less than the second length, and a concave side having a third radius, the outer bearing assembly further having a second part as a mirror image of the first part, such that the two parts of the outer bearing assembly joined together form the outer bearing assembly constrained in the depressed raceway of the inner bearing assembly.

This embodiment further provides that the first part of the outer bearing assembly further includes a centered notch on an upper end and the second part of the outer bearing assembly has a centered extension of the width of the notch on an upper end, such that the first and second parts are hinged by a pin through a hole through the extension and sides of the notch, and wherein the first and second parts each have a descending piece with a hole in the axis direction, offset such that the holes in the descending pieces align below the closed outer bearing assembly with the outer bearing assembly constrained to rotate in the inner bearing assembly.

Additionally, the two parts of the inner bearing assembly of the swing hanger each have holes for screw fasteners whereby the two parts joined by the key slot and the key element are adapted to assemble over a crossbar of a swing set and to be secured to the crossbar by the screw fasteners. The swing hanger further comprises a hole through one part of the outer bearing unit to the bearing surface with a counterbore enclosing a Zerk fitting for applying lubricant to the bearing surface. In this embodiment a shackle is joined over the side-by-side descending pieces by a first bolt and nut, an opposite end of the shackle joined by a second bolt and nut to an open link of a first length of chain.

In this or another embodiment, one or both of the first and second parts of both the inner and the outer bearing assemblies are formed from cast iron. In this embodiment, the cast iron parts of the swing hanger are coated at least on partial regions of the parts by a non-corrosive coating material comprising zinc powder, aluminum powder, chromic acid, and deionized water. Additionally, the bearing surfaces are provided by bearing inserts of carbon or carbide, infused with a lubricating material. In operation, two swing hangers are operational, side-by-side. A chain connects the swing hangers, one each, to opposite ends of a swing seat.

DETAILED DESCRIPTION OF THE INVENTION

Figure 1:
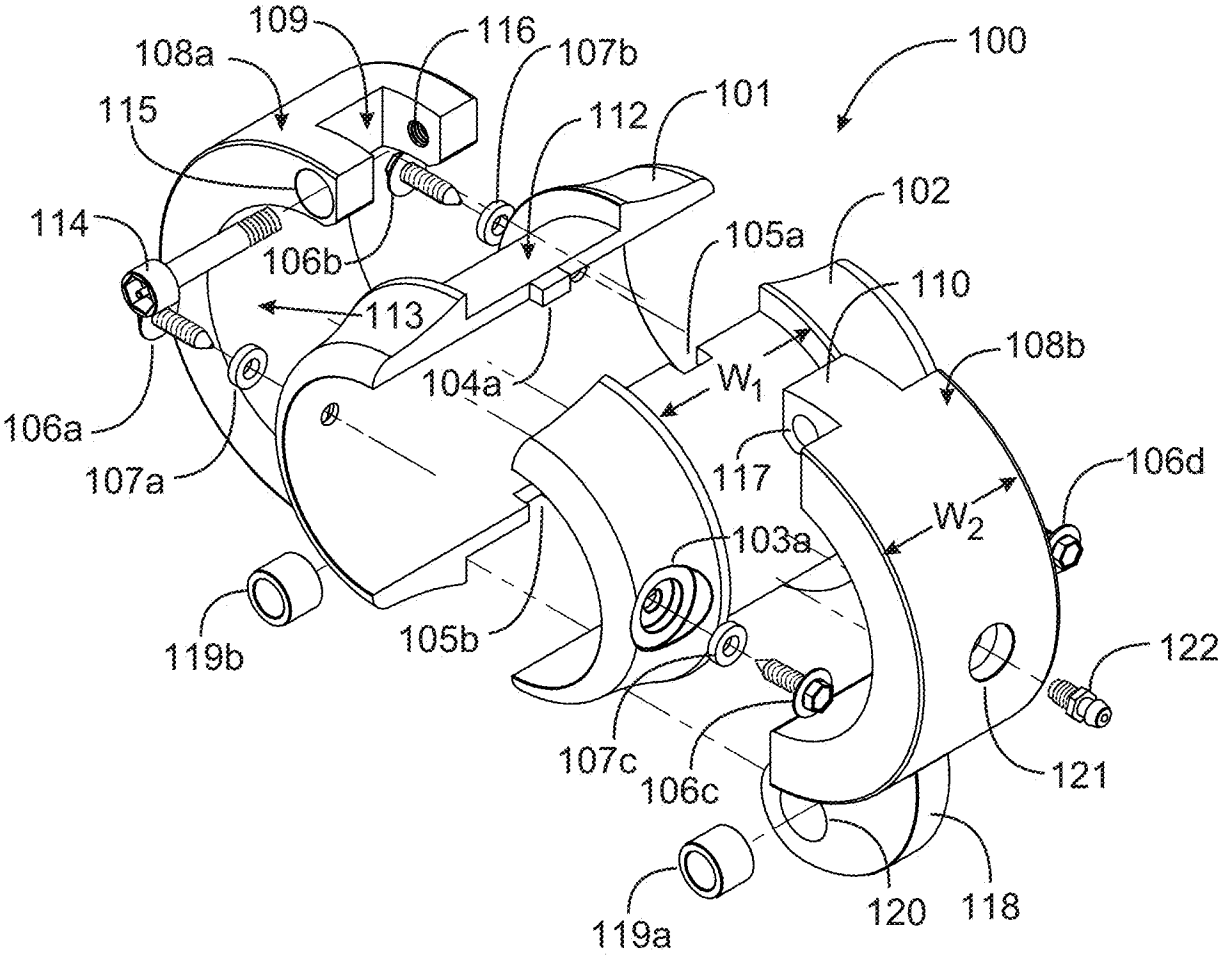

FIG. 1 is an exploded view of a swing hanger 100 in an embodiment of the present invention. An inner bearing assembly comprises two mating parts 101 and 102. Part 101 has a key element 104*a* that mates with a key slot 105*a*, and a further key element not visible that mates with a key slot 105*b*. The inner bearing assembly is assembled to a swing crossbar by closing the mating parts 101 and 102 around the crossbar, and securing to the crossbar with self-tapping screws 106*a*, 106*b*, 106*c*, and 106*d*, using, in this example washers 107*a* through 107*d*. In this embodiment washers

107*a* and 107*c* seat within hardware recesses 103*b* and 103*a*, respectively. Engagement of the key elements with the key slots ensures horizontal alignment of the mating parts. A depressed raceway of width $W_1$ is provided by the assembled inner bearing parts with a bearing surface 112.

An outer bearing unit is provided in two parts 108*a* and 108*b* in a width $W_2$ that is slightly less than the width $W_1$ of the depressed raceway of the assembled inner bearing unit, such that a bearing surface 113 of the outer bearing unit will mate with the bearing surface 112 of the inner bearing unit assembled.

Part 108*a* of the outer bearing unit has a notch 109 with a through hole 115 aligned with a threaded hole 116 for a bolt 114 that, in assembly also passes through hole 117 in an extension 110 from part 108*b* that engages notch 109 in assembly. This provides a hinge for the outer bearing unit that, when assembled, has no protrusion at all from the circular nature of the outer bearing unit.

Part 108*b* of the outer bearing unit has a descending piece 118 with a bushing 119*a* in a hole 120, that is offset from a center of width of part 108*b*. A similar descending piece is offset on part 108*a* with a hole and a bushing 119*b* but not seen in FIG. 1. When the parts of the outer bearing assembly are closed around the inner bearing assembly the holes in the descending pieces align, as is described below with reference to other figures.

A threaded hole in a counterbore 120 provides for a Zerk fitting grease nipple 121 for lubrication of the bearing surfaces of the outer and inner bearing units when assembled. The counterbore 120 for the Zerk fitting is of a depth that the outer extension of the nipple is below the outer diameter of part 108*b* of the outer bearing unit.

Figure 2:
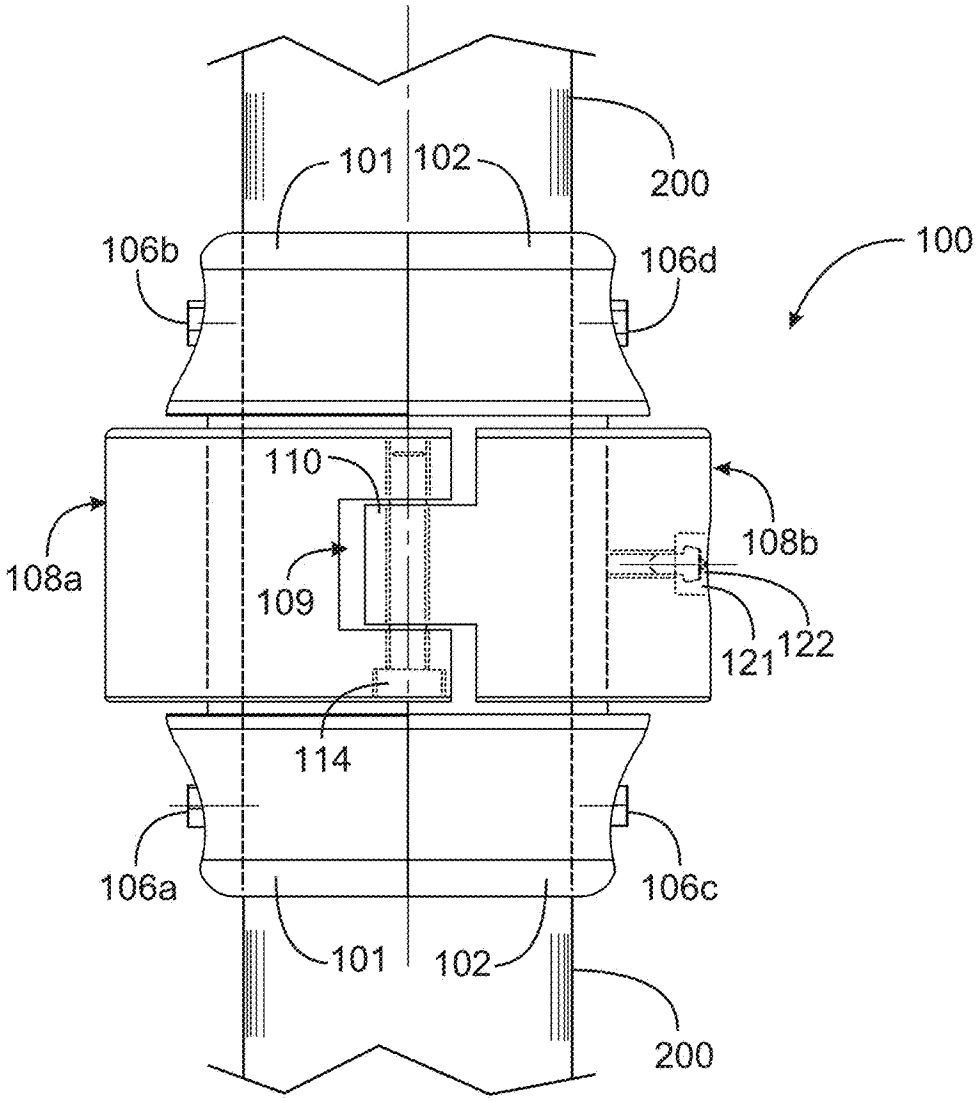

FIG. 2 is a top view of the swing hanger 100 of FIG. 1 in an embodiment of the invention. In this view the crossbar 200 of a swing frame is shown, with the swing hanger of the invention engaged to the crossbar. In many embodiments the crossbar is a length of schedule 40 pipe, and the swing hanger is adapted to the size of schedule 40 pipe. The two parts 101 and 102 of the inner bearing unit are illustrated assembled to one another and fastened to crossbar 200 by screw fasteners 106*a*, 106*b*, 106*c* and 106*d*. It is not evident in FIG. 2, but parts 101 and 102 are joined by engagement of key 104*a* and key slot 105*a* (see FIG. 1), so the alignment of the depressed raceway is assured.

Also evident in FIG. 2 is the engagement of part 108*a* and 108*b* of the outer bearing unit by a notch 109 in part 108*a* engaging an extension 110 from part 108*b* with a bolt 114, thus forming the hinge that enables the outer bearing unit to by assembled to and to be removed from the inner bearing unit in a manner that there is no protrusion from the outer diameter of the outer bearing unit.

Further in FIG. 2 the counterbore 121 and the Zerk fitting 122 are illustrated with the Zerk fitting being recessed in the counterbore so there is no protrusion beyond the outer diameter of the outer bearing unit.

Figure 3:
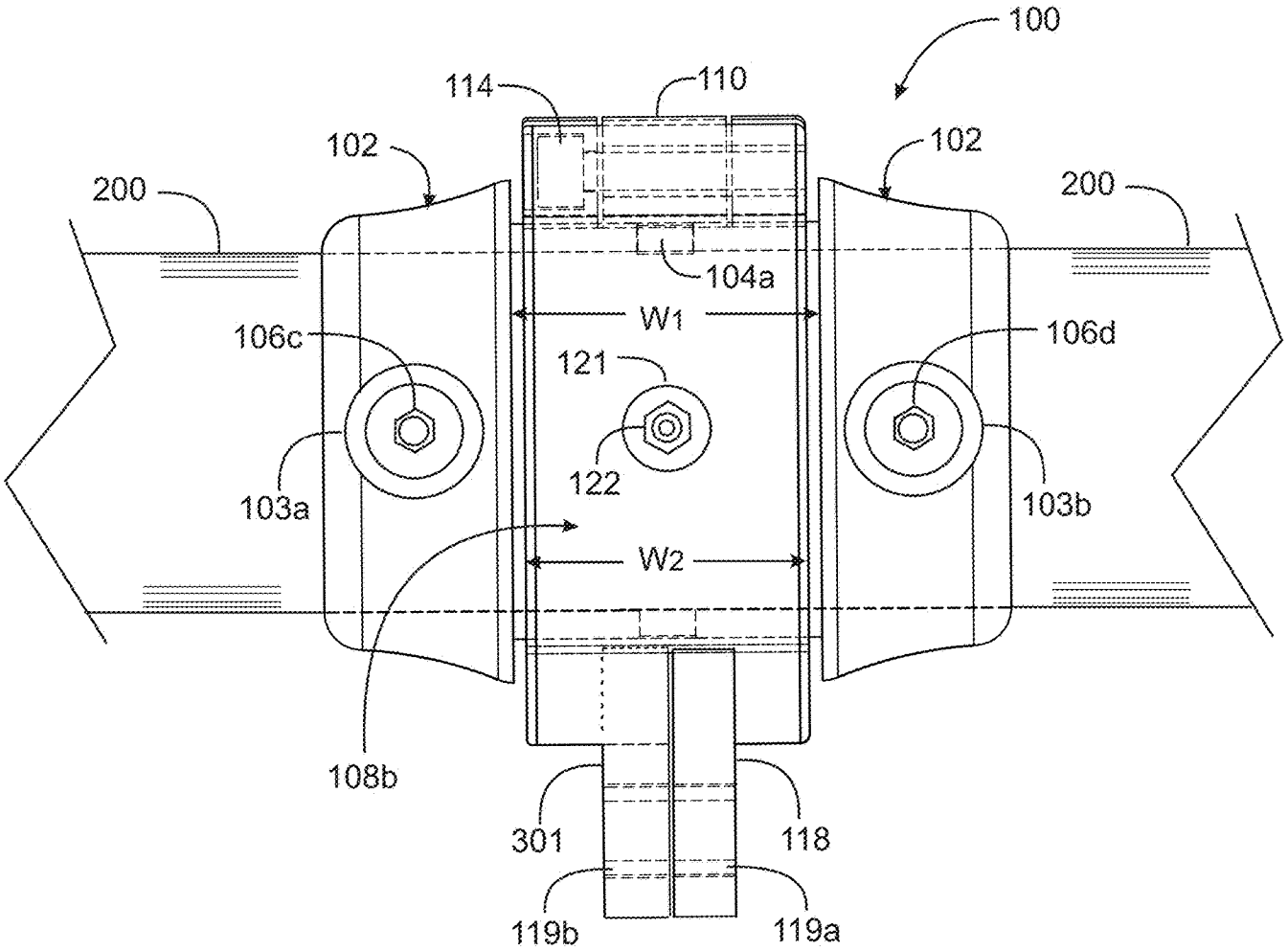

FIG. 3 is a side elevation view of swing hanger 100 of FIGS. 1 and 2 in an embodiment of the invention. The swing hanger is illustrated in FIG. 3 assembled to crossbar 200, which, as described before, in this example is schedule 40 pipe. In this side elevation view part 108*b* of the outer bearing unit is seen engaged to the inner bearing unit of which one portion 102 is seen in the figure. The widths W1 and W2 indicated in FIG. 1 are also indicated in FIG. 2. Descending piece 118 of part 108*b* of the inner bearing unit is illustrated in FIG. 3, and a descending piece 301 from part 108*a* of the inner bearing unit, that is not seen in FIG. 1, is shown as aligned with piece 118, such that holes in the descending pieces align as well.

FIG. 4 is an end view of the swing hanger of FIGS. 1, 2 and 3 in an embodiment of the invention, without showing the crossbar upon which the assembly is mounted. In FIG. 4, the inner bearing unit comprising parts 101 and 102, each rigidly fastened to the crossbar by fasteners 106*a* and 106*b* respectively is illustrated, and the outer bearing unit comprising parts 108*a* and 108*b* is illustrated assembled to the raceway of the inner bearing assembly, closed with descending pieces 118 and 301 aligned. Hole 115 with bolt 114 is illustrated providing the hinge pivot for the outer bearing unit.

FIG. 5 is a perspective view of the swing hanger 100 of FIGS. 1, 2, 3 and 4 in an embodiment of the invention. FIG. 5 shows the outer bearing unit comprising parts 108*a* and 108*b* closed and engaged over the inner bearing unit comprising parts 101 and 102 fastened to a crossbar by fasteners 106*a*, 106*c* and 106*d* shown. Fastener 106*b* is not seen in FIG. 5. The parts 108*a* and 108*b* are illustrated as hinged by bolt 114 through extension 110 from part 108*b* in notch 109 in part 108*a*. The outer bearing unit is closed over the inner bearing unit with the bearing surfaces of the two units intimately engaged. Counterbore 121 is shown with Zerk fitting 122 within the counterbore. Descending piece 118 from part 108*b* is seen but piece 301 from part 108*a* is not seen, as it is behind piece 118 in this view.

In one embodiment of the swing hanger the inner and outer bearing units are machined to a fine bearing surface with matching radius, such that the bearing surfaces fit smoothly together and rotate relative to one another as bearings. In another embodiment the radius of the inner bearing surface is substantially less than the radius of the out bearing surface, and each of the inner and the outer bearing units are fitted with semi-circular inserts of a bearing material like, for example carbon or graphite. Each of the inserts is provided with a hole aligning with a hole through the portion of the outer bearing unit that has the Zerk fitting, such that lubricant through the Zerk fitting will pass through to the mating bearing surfaces of the inserts.

In the prior art the hanger material was stainless steel. In the improved embodiment of the instant invention the material is cast iron. Cast iron is durable and lasts a long time with little or no maintenance. Cast iron offers several benefits compared to steel, such as improved corrosion resistance, castability along with a homogenous hardness and structure over the cross section.

Finished assemblies are treated with a corrosion resistant coating, in one embodiment Dacromet™. Further, cast iron is more cost efficient and has proven to be successful in extreme weather conditions and climates.

The Dacromet™ material is a type of anti-corrosion coating composed of zinc powder, aluminum powder, chromic acid, and deionized water, which replaces the conventional galvanization which causes serious environmental pollution. Dacromet™ coating is an excellent choice for playground products.

Figure 6:
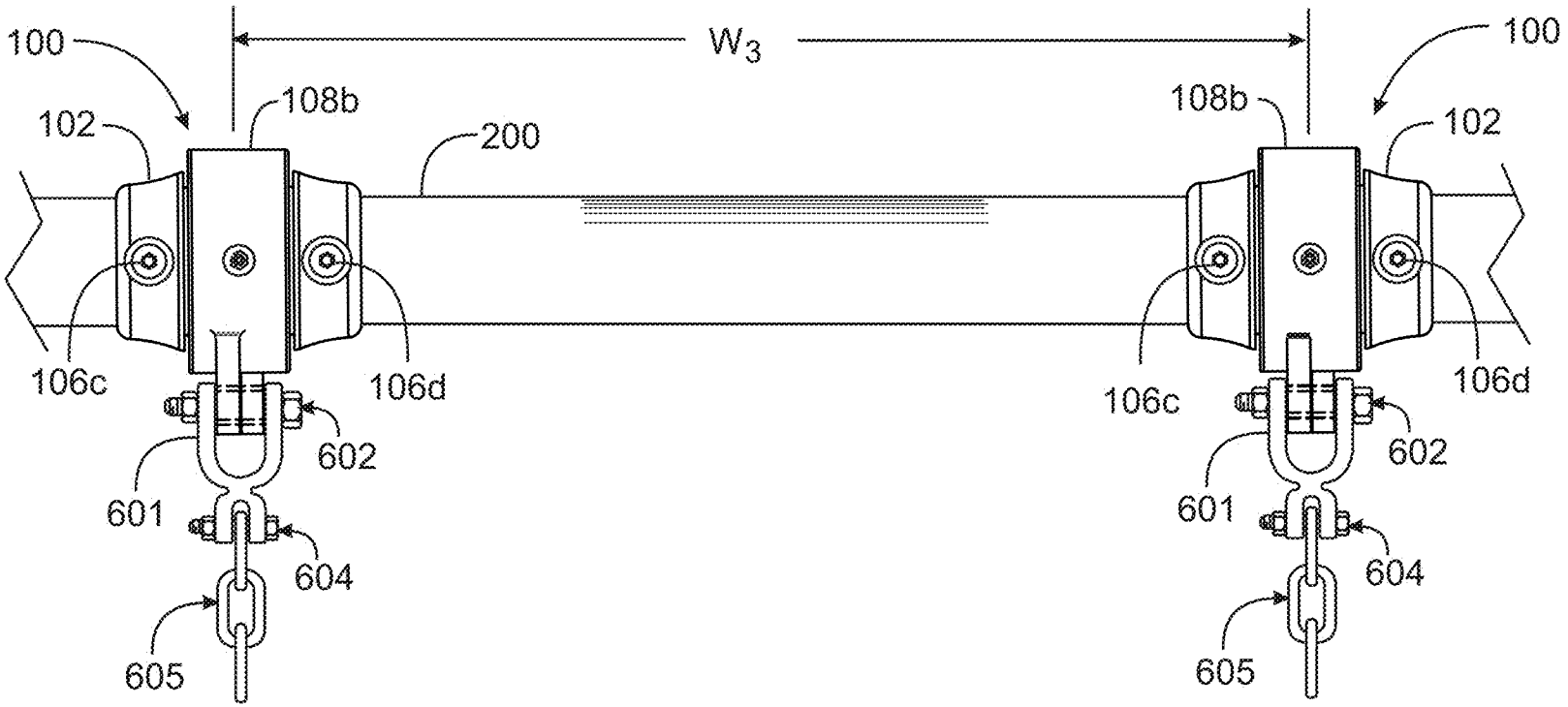

FIG. 6 is an elevation view of a crossbar 200 of a swing set, with two swing hangers 100 anchored to the crossbar at a width of W3. Width W3 is determined at least in part by the nature of a seat that may be suspended at each end of the seat from chains 605 depending from the swing hangers. To suspend the chains, at each swing hanger a shackle 601 is attached to the side-by-side descending pieces 118 and 301 from the inner bearing units of the swing hangers. The shackle is attached by a bolt and nut 602. The chain 605 is attached to the shackle by another bolt and nut 604. The skilled person will understand from previous description that the chains and seat (not shown) may rotate completely over the crossbar by virtue of the mating bearing units.

The skilled person will understand that the embodiments illustrated and described are entirely exemplary and are not limiting to the scope of the invention. There are a variety of ways that parts and materials may be altered and remain within the scope of the invention. The scope of the invention is limited only by the claims that follow.

The invention claimed is:

1. A swing hanger comprising:

an inner bearing assembly having a first part in a shape of a semi-circle with a concave side having a first radius and a first length in a direction of an axis of the semi-circle, and a convex side having a centered, depressed raceway of a second length less than the first length, presenting a convex bearing surface of a second radius greater than the first radius, the inner bearing assembly further having a second part as a mirror image of the first part, such that the two parts joined form the inner bearing assembly having a circular center opening with a diameter twice the first radius, and an outward facing circular depressed raceway formed of the depressed raceways of the first and second parts, the first part having a key slot and the second part having a key element sized to the key slot, such that the two parts joined are constrained from relative movement in the direction of the axis;

an outer bearing assembly having a first part in a shape of a semi-circle with a convex side presenting a bearing surface having the second radius and a third length in the direction of the axis less than the second length, and a concave side having a third radius, the outer bearing assembly further having a second part as a mirror image of the first part, such that the two parts of the outer bearing assembly joined together form the outer bearing assembly constrained in the depressed raceway of the inner bearing assembly;

wherein the first part of the outer bearing assembly further has a centered notch on an upper end and the second part of the outer bearing assembly has a centered extension of the width of the notch on an upper end, such that the first and second parts are hinged by a pin through a hole through the extension and sides of the notch, and wherein the first and second parts each have a descending piece with a hole in the axis direction, offset such that the holes in the descending pieces align below the closed outer bearing assembly with the outer bearing assembly constrained to rotate in the inner bearing assembly.

2. The swing hanger of claim 1 wherein the two parts of the inner bearing assembly each have holes for screw fasteners whereby the two parts joined by the key slot and the key element are adapted to assemble over a crossbar of a swing set and to be secured to the crossbar by the screw fasteners.

3. The swing hanger of claim 1 further comprising a hole through one part of the outer bearing unit to the bearing surface with a counterbore enclosing a Zerk fitting for applying lubricant to the bearing surface.

4. The swing hanger of claim 1 further comprising a shackle joined over the side-by-side descending pieces by a first bolt and nut, an opposite end of the shackle joined by a second bolt and nut to an open link of a first length of chain.

5. The swing hanger of claim 1 wherein one or both of the first and second parts of both the inner and the outer bearing assemblies are formed from cast iron.

6. The swing hanger of claim 5 wherein the cast iron parts of the swing hanger are coated at least on partial regions of the parts by a non-corrosive coating material comprising zinc powder, aluminum powder, chromic acid, and deionized water.

7. The swing hanger of claim 1 wherein the bearing surfaces are provided by bearing inserts of carbon or carbide, infused with a lubricating material.

8. A swing hanger system, comprising:

two swing hangers, each having an inner bearing assembly having a first part in a shape of a semi-circle with a concave side having a first radius and a first length in a direction of an axis of the semi-circle, and a convex side having a centered, depressed raceway of a second length less than the first length, presenting a convex bearing surface of a second radius greater than the first radius, the inner bearing assembly further having a second part as a mirror image of the first part, such that the two parts joined form the inner bearing assembly having a circular center opening with a diameter twice the first radius, and an outward facing circular depressed raceway formed of the depressed raceways of the first and second parts, the first part having a key slot and the second part having a key element sized to the key slot, such that the two parts joined are constrained from relative movement in the direction of the axis;

an outer bearing assembly having a first part in a shape of a semi-circle with a convex side presenting a bearing surface having the second radius and a third length in the direction of the axis less than the second length, and a concave side having a third radius, the outer bearing assembly further having a second part as a mirror image of the first part, such that the two parts of the outer bearing assembly joined together form the outer bearing assembly constrained in the depressed raceway of the inner bearing assembly, the first part of the outer bearing assembly further having a centered notch on an upper end and the second part of the outer bearing assembly having a centered extension of the width of the notch on an upper end, such that the first and second parts are hinged by a pin through a hole through the extension and sides of the notch, and wherein the first and second parts each have a descending piece with a hole in the axis direction, offset such that the holes in the descending pieces align below the closed outer bearing assembly with the outer bearing assembly constrained to rotate in the inner bearing assembly;

a swing frame with an elevated crossbar with the two swing hangers secured to the crossbar at a first width apart; and a shackle joined to each swing hanger and to an open link of a length of chain, with a swing seat joined to a lower end of each length of chain from the two swing hangers;

wherein the swing seat at the ends of the lengths of chain may be rotated over the crossbar any number of times without fouling the chain.

9. The swing hanger system of claim 8 wherein the swing hangers each have a Zerk fitting enclosed in a counterbore whereby the bearing surfaces may be lubricated periodically.

10. The swing hanger system of claim 8 further comprising bearing surfaces provided by bearing inserts, whereby the bearing inserts may be removed and replaced periodically.

* * * * *